United States Patent [19]

Tsuchiya et al.

[11] Patent Number: 4,459,830

[45] Date of Patent: Jul. 17, 1984

[54] YARN CLIPPING DEVICE FOR CIRCULAR KNITTING MACHINES

[75] Inventors: Koji Tsuchiya, Hyogo, Japan; David Pernick, Kings Point, N.Y.

[73] Assignee: Monarch Knitting Machinery Corporation, Glendale, N.Y.

[21] Appl. No.: 395,098

[22] Filed: Jul. 6, 1982

[51] Int. Cl.[3] ..... D04B 15/61; D04B 35/00

[52] U.S. Cl. ..... 66/140 S; 66/147

[58] Field of Search ..... 26/10.4, 15 R; 66/138, 66/140 S, 147, 149 R

[56] References Cited

U.S. PATENT DOCUMENTS

| | | | |
|---|---|---|---|
| 445,423 | 1/1891 | Cahill | 66/147 |
| 1,375,597 | 4/1921 | Leibowitz | 26/15 R |
| 2,906,296 | 9/1959 | Ancet et al. | 26/15 R |
| 3,164,879 | 1/1965 | Sprüngli | 26/10.4 |
| 3,234,761 | 2/1966 | Stahl et al. | 66/140 S |
| 4,385,507 | 5/1983 | Sawazaki | 66/140 R |

FOREIGN PATENT DOCUMENTS

| | | | |
|---|---|---|---|
| 140522 | 4/1961 | U.S.S.R. | 66/147 |

*Primary Examiner*—Wm. Carter Reynolds
*Attorney, Agent, or Firm*—Nathan Levin

[57] ABSTRACT

An attachment for use with multi-feed circular knitting machines of the type having a rotary needle cylinder and having yarn striper boxes at the feeds thereof. The boxes serving to change and to cut and clamp the yarns fed to and knit by the machine during the making thereon of coursewise striped fabric. The yarn changing operation resulting in undesirably long unknit terminal portions of the changed yarns extending inwardly from the inner side of the tubular fabric being made. The terminal portions of the yarns having cut ends. The attachment comprising a device having yarn clipping means disposed within the tubular fabric and rotating in unison with the needle cylinder to cut and to shorten the terminal portions of the changed yarns as the tubular fabric continues to be made, whereby the yarns are cut firstly by the striper boxes and secondly by the yarn clipping means.

2 Claims, 9 Drawing Figures

YARN CLIPPING DEVICE FOR CIRCULAR KNITTING MACHINES

Figure 1:
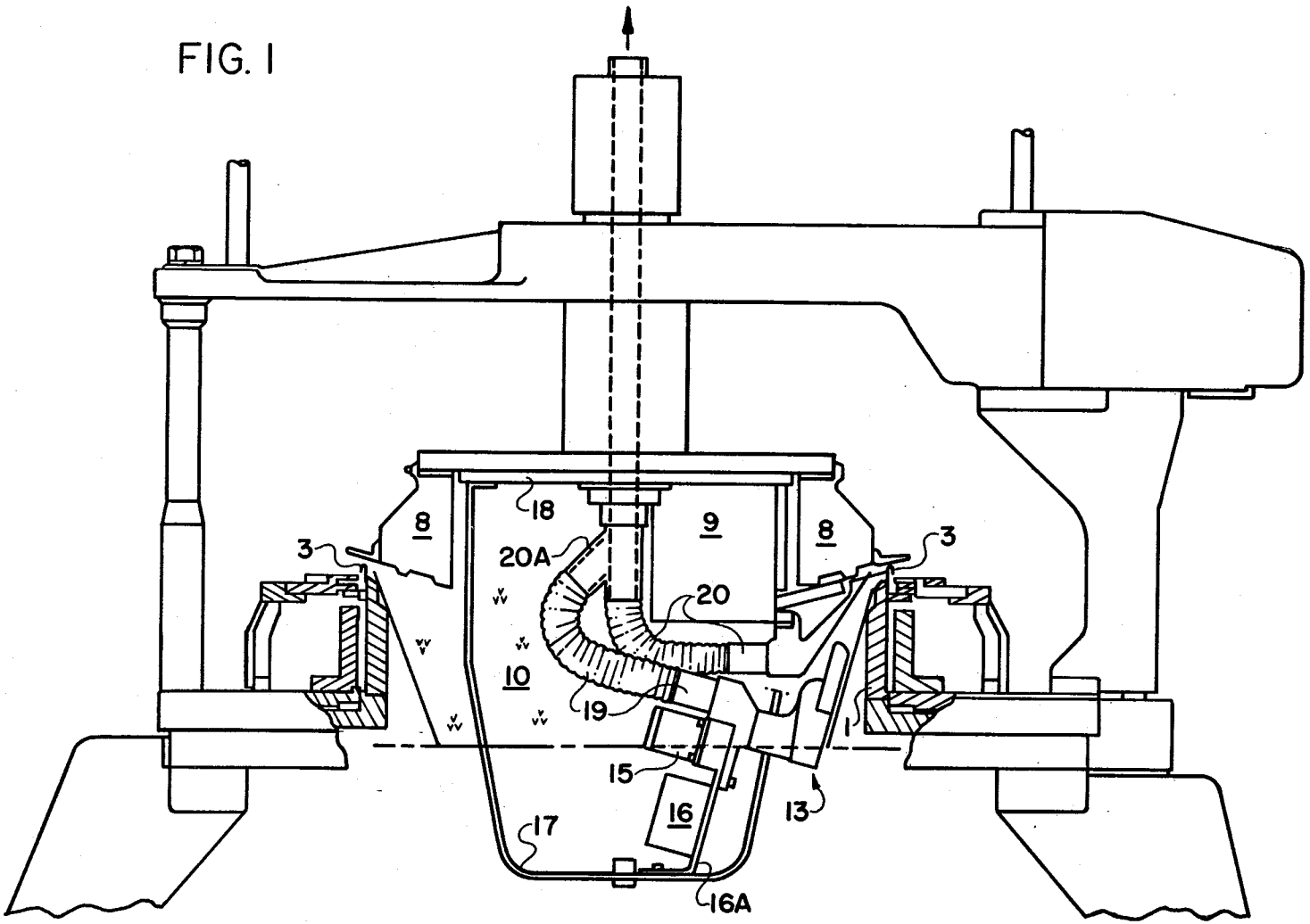

The present invention relates generally to the art of knitting and more particularly to an improvement in multi-feed circular knitting machines of the type having yarn striper boxes at the feeds thereof to change the yarns fed to and knit by the machines during the making thereon of coursewise striped tubular knit fabric. The yarn changing operation results in unknit terminal portions of the changed yarns extending freely from the inner side of the tubular fabric in the wales in which the yarns are changed.

The length of the terminal portions of the changed yarns is undesirably long, and, heretofore, such terminal portions have been dealt with only after the fabric is taken from the machine, either by removing the same from the fabric or by making allowances therefor in subsequent operations upon the fabric. Obviously such post-knitting operations add to the fabric cost.

Accordingly, it is the principal object of the present invention to avoid such post-knitting operations and costs, and to provide such circular knitting machines with means to automatically shorten the undesirably long terminal portions of the changed yarns to a more desirable length during the knitting of the coursewise striped tubular fabric.

It is also an object to provide a circular knitting machine with a yarn clipping device within the tubular fabric made on the machine to automatically cut and trim the terminal portions of the changed yarns as the fabric is being knit.

With the above and other objects in view as will become apparent from the accompanying drawings and the description thereof, the invention resides in the provision of a yarn clipping device for multi-feed circular knitting machines as shown and as described, and as set forth in the appended claims.

Figure 2:
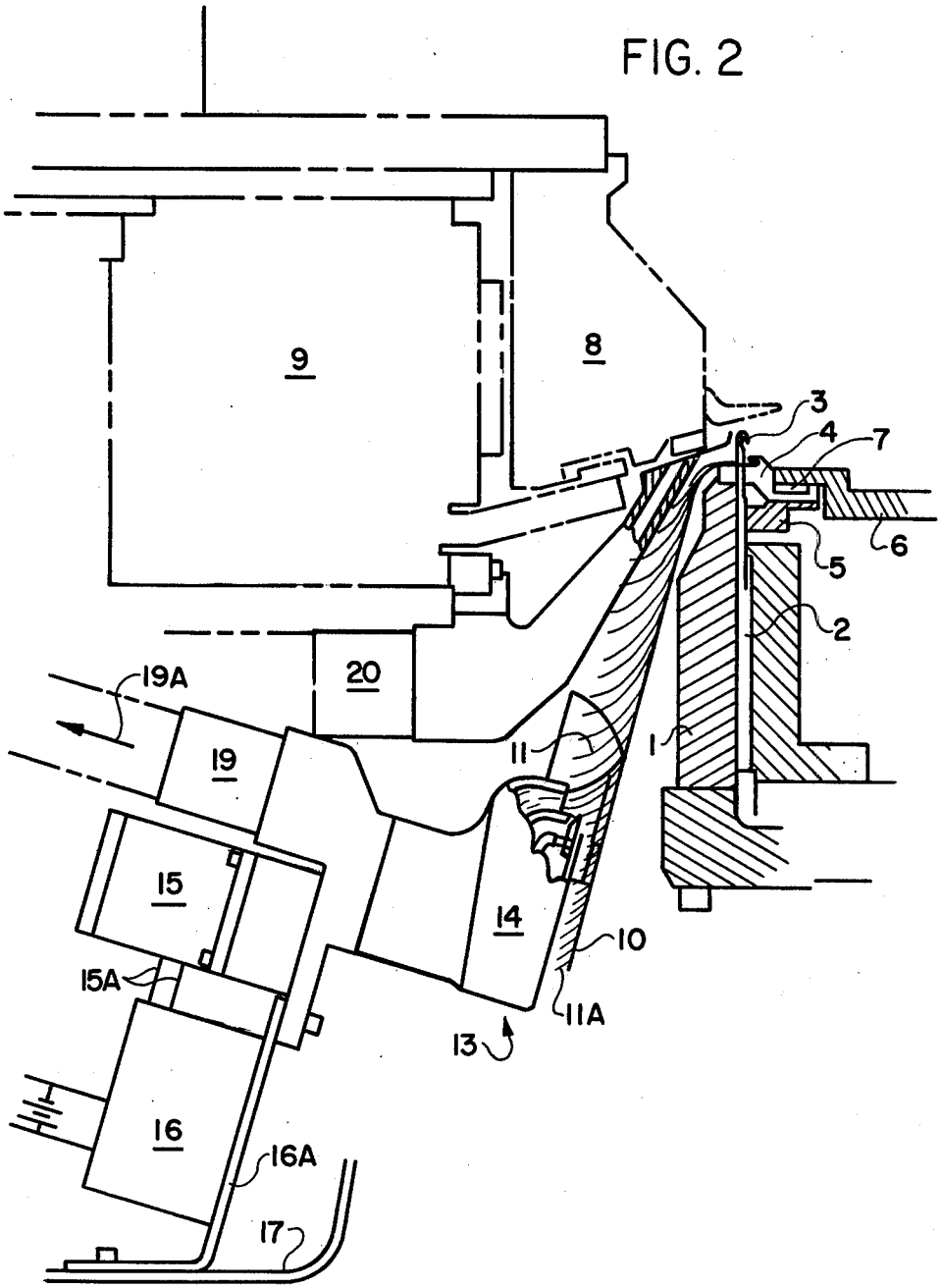
Figure 3A:
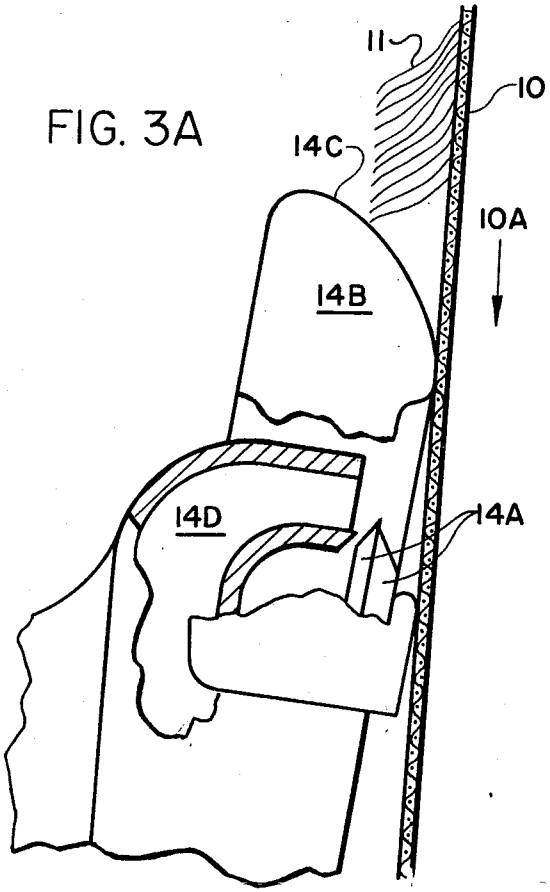
Figure 3B:
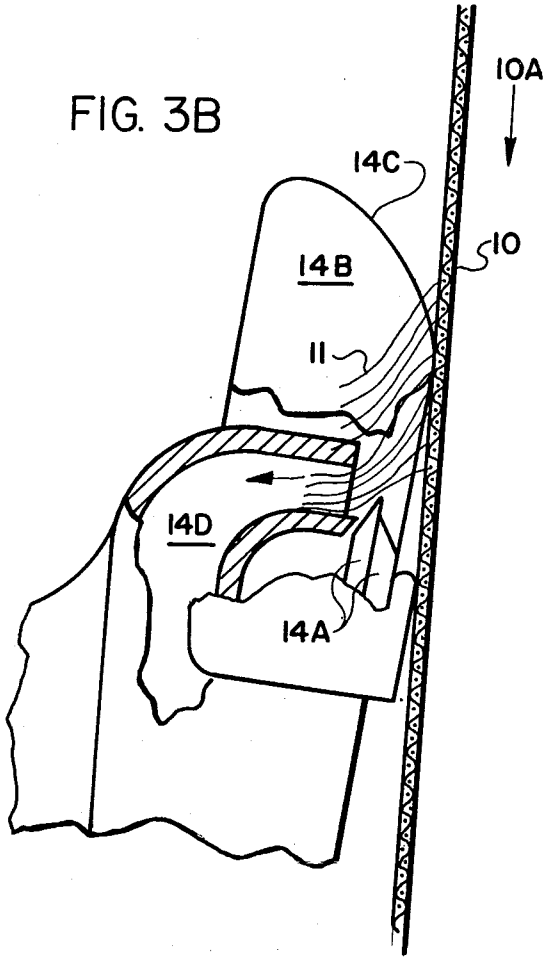
Figure 3C:
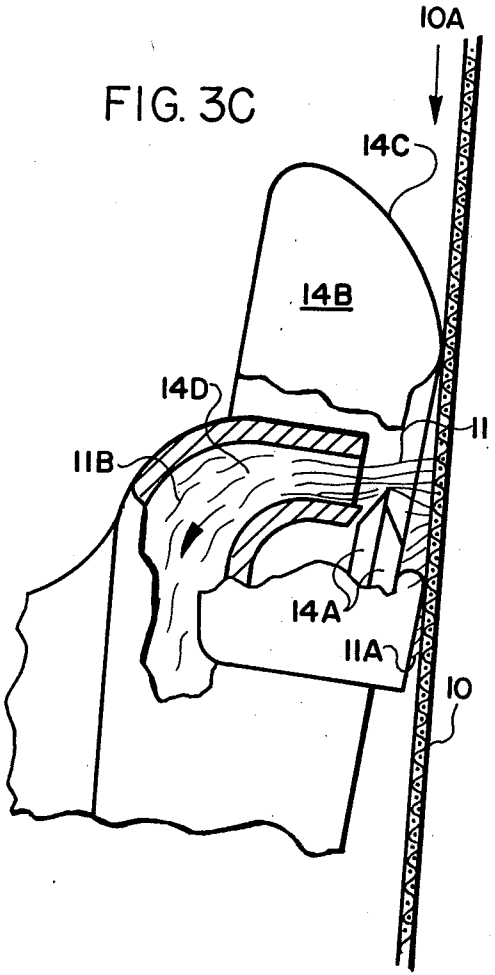
Figure 6:
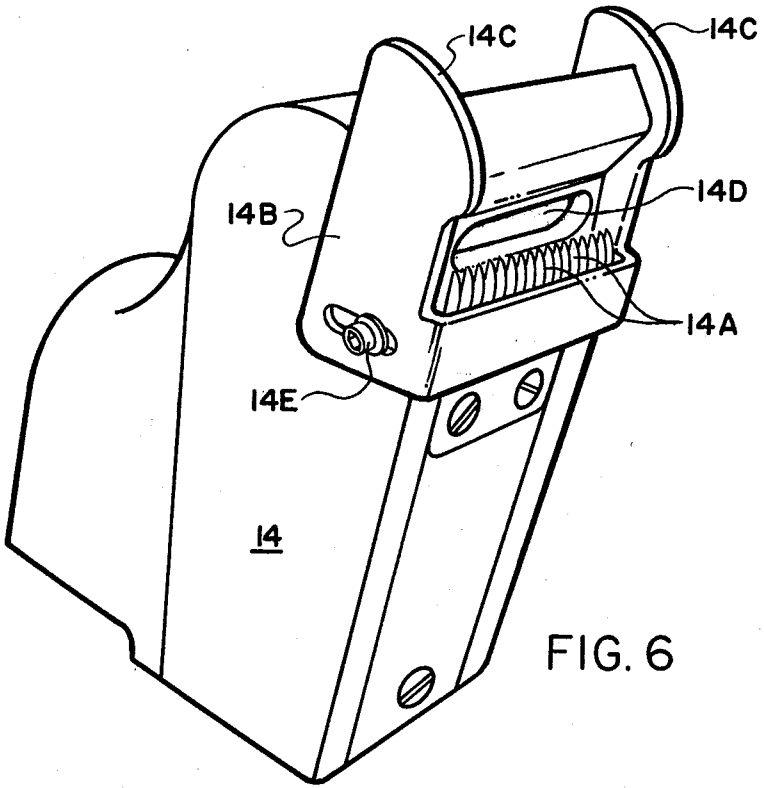
Figure 3D:
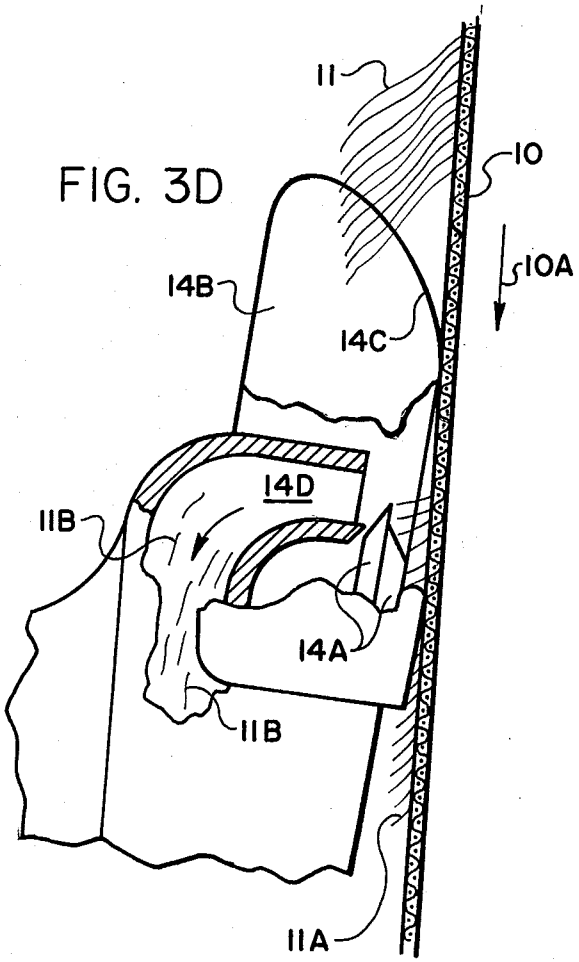
Figure 5:
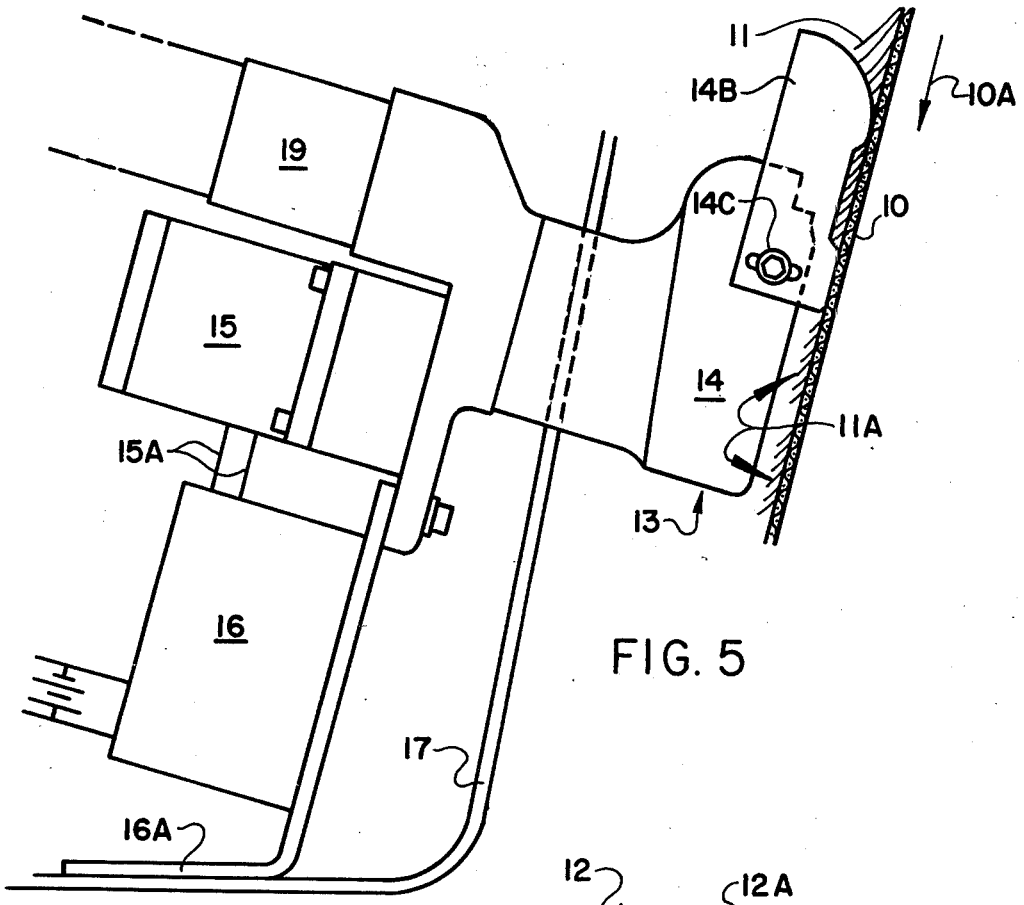
Figure 4:
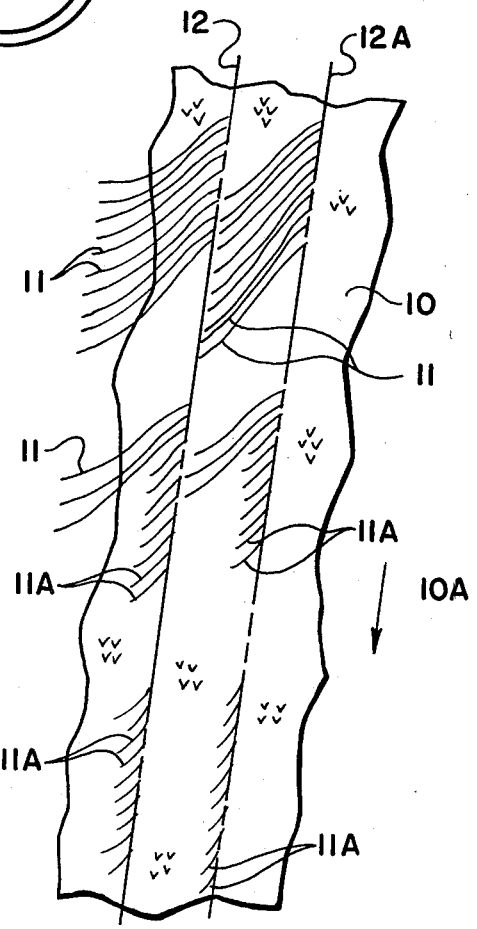

In the drawings:

FIG. 1 is an elevational view, partly in section, showing a portion of a multi-feed circular knitting machine of the type having yarn striper boxes with the yarn clipper device of the present invention in position thereon, FIG. 2 is an enlarged view of a portion of FIG. 1, FIGS. 3A, 3B, 3C, and 3D are views showing steps in the cutting and trimming of the changed yarns by the clipper device, FIG. 4 is a view showing the inner side of a section of the fabric with terminal portions of the changed yarns extending therefrom, FIG. 5 is a view showing the interaction between the yarn clipper device and the terminal portions of the changed yarns, and FIG. 6 is a perspective view of the yarn clipper device with the fabric guide affixed thereto.

A multi-feed circular knitting machine, with which the present invention may be used, is shown in FIGS. 1 and 2 wherein the machine has a rotary needle cylinder 1, a rotary circle of latch needles 3 in slots 2 formed in the cylinder, a rotary sinker bed 5, and a circle of rotary sinkers 4 radially movable in slots formed in the sinker bed, the sinkers being so moved by cams 7 disposed in sinker cap 6.

A stationary yarn striper box 8 is provided at each feed of the machine to change, to cut, and to clamp the yarns fed to the machine as selectively determined by an electronic rotary control box actuator 9 whereby coursewise striped tubular knit fabric is made on the machine. When the yarns are changed, unknit terminal portions 11 thereof extend freely from the inner side of the fabric 10 in the wales in which the yarns are changed, FIG. 4, wherein non-trimmed and trimmed terminal portions 11, 11A, respectively, of the changed yarns extend from fabric 10 in the spaced wales 12, 12A, between which the idled and active yarns are both knit in the fabric. The terminal portions 11 at the upper end of the fabric 10 shown in FIG. 4 have not as yet been trimmed and are undesirably long, FIGS. 3A, 3B; the terminal yarn portions at the middle of fabric 10 are partially trimmed at 11A and are partially untrimmed as at 11, FIG. 3C; while the terminal portions 11A at the lower end of fabric 10 have all been trimmed, FIG. 3D. The undesirably long terminal portions are trimmed to a more desirable length by the present device while the fabric itself is being knit.

The yarn clipping device is indicated generally at 13 in FIGS. 1, 2, 6, and has a head 14 the blades 14A, 14A of which are actuated in customary manner by a motor 15 which is connected via wires 15A to a transformer 16 which in turn is connected to a suitable source of electricity. The device, via bracket 16A, is suitably joined to and supported by a U-shaped bracket 17 which in turn is supported by and extends downwardly from a rotary plate 18 of the machine to rotate therewith and with the needle circle. The device is located wholly within the tubular fabric 10 being made and at a suitable level between the striper boxes 8 and the fabric take-up (not shown) of the machine.

A U-shaped fabric guide 14B is adjustably secured to the opposite sides of the cutter head 14 by screws 14E so that its spaced cam faces 14C, 14C may be adjustably placed in suitable tensioned contact with the inner side of moving fabric 10 as the latter is made on the needle circle and moves downwardly therefrom toward the fabric take-up of the machine. Guide 14B is fashioned to permit access therethrough to cutting teeth 14A and to a suction tube 14D behind the teeth in the cutter head. Cam faces 14C are sufficiently spaced to permit the terminal yarn portions 11 to pass therebetween, after which the latter are drawn into suction tube 14D and while so positioned the cutters 14A cut the same to provide shortened ends 11A thereof extending from the fabric and to provide loose cut ends 11B which are sucked through tube 14D to be exhausted from the machine. A suction tube 19 at the rear of cutter head 14 is operatively related to tube 14D to supply suction therein, the tube 19 joining an existing vacuum exhaust tube 20 at a Y-shaped junction 20A thereof the tubes rotating together. The tube 20 exhausts cut yarn ends from the striper boxes 8. The present device may be used upon untrimmed terminal yarn portions 11 the length of which may vary with each of particular machines and may be up to several inches in length, while the trimmed terminal yarn portions 11A may be as little as one quarter inch in length.

While the device need not be actuated when the machine is not in operation, such as for relatively long periods of time, the device is preferably in continuous actuation even when the machine is not in operation for relatively short periods of time, such as when the fabric is being removed from the machine, or the like.

While the clipping device of the present invention may be used upon the machine shown in U.S. Pat. No. 4,385,507 it may also be used upon other multi-feed circular knitting machines having striper boxes and making coursewise striped tubular fabric.

As appears in FIG. 4 the several spaced groups of terminal yarn portions 11, 11A in wales 12, 12A are present in the courses in which the yarns are changed. While the machine shown has a single circular set of cylinder latch needles, the present invention is not limited in its application to such machines.

We claim:

1. An attachment for use with multi-feed circular knitting machines of the type having yarn changing striper boxes at the feeds thereof to change and to cut and clamp the yarns fed to and knit by the machine during the making thereon of coursewise striped tubular fabric and in which such action by the striper boxes results in undesirably long unknit terminal portions of the changed yarns which have cut ends and which extend inwardly from the inner side of the tubular fabric being made, the attachment comprising a device having yarn clipping means disposed within the tubular fabric in such manner that the yarn clipping means is positioned to cut and to shorten the terminal portions of the changed yarns as the tubular fabric continues to be made, whereby the yarns are cut firstly by the striper boxes and secondly by the yarn clipping means.

2. An attachment as in claim 1 wherein the knitting machine is of the type which also has a rotary needle cylinder, and wherein the device rotates in union with the needle cylinder.

* * * * *